US009951558B2

(12) United States Patent
Maragliano

(10) Patent No.: US 9,951,558 B2
(45) Date of Patent: Apr. 24, 2018

(54) APPARATUS FOR DETACHABLY SECURING A LADDER TO A SHORING STRUCTURE AND METHOD OF USE THEREOF

(71) Applicant: John J. Maragliano, Newburgh, NY (US)

(72) Inventor: John J. Maragliano, Newburgh, NY (US)

( * ) Notice: Subject to any disclaimer, the term of this patent is extended or adjusted under 35 U.S.C. 154(b) by 0 days.

(21) Appl. No.: 14/215,258

(22) Filed: Mar. 17, 2014

(65) Prior Publication Data

US 2015/0259982 A1 Sep. 17, 2015

(51) Int. Cl.
*E06C 7/50* (2006.01)
*E06C 7/18* (2006.01)

(52) U.S. Cl.
CPC ..... *E06C 7/505* (2013.01); *E06C 7/188* (2013.01); *Y10T 29/49947* (2015.01)

(58) Field of Classification Search
CPC .. E06C 1/04; E06C 5/36; F16M 11/24; A47B 9/00
USPC ..... 182/107, 200; 248/157; 108/144.11
See application file for complete search history.

(56) References Cited

U.S. PATENT DOCUMENTS 3,792,756 A * 2/1974 Kelly ..... E06C 7/48 182/107
3,903,991 A * 9/1975 Phelan ..... E06C 1/34 182/229
4,280,590 A * 7/1981 Polizzi ..... E06C 7/48 182/107
4,593,599 A * 6/1986 Yeardley ..... D07B 1/18 294/74

(Continued)

FOREIGN PATENT DOCUMENTS

CA 2473665 A1 * 2/2006 ..... E04D 15/00
CA 2473665 A1 * 2/2006 ..... E04D 15/00

(Continued)

OTHER PUBLICATIONS

MLA Style "configure." YourDictionary, n.d. Web. Aug. 23, 2016. <http://www.yourdictionary.com/configure> Read more at http://www.yourdictionary.com/configure#americanheritage#V8EldAYf5WqdbZeZ.99.*

*Primary Examiner* — Katherine W Mitchell
*Assistant Examiner* — Candace L Bradford
(74) *Attorney, Agent, or Firm* — Saile Ackerman LLC; Stephen B. Ackerman; Rosemary L. S. Pike

(57) ABSTRACT

A restraining system and method for detachably securing a ladder to a shoring or excavation support structure. The restraining assembly, primarily configured from an elongated flexible restraining material, includes a proximal member, possessing a fastener configured to removably attach onto either side rail of a ladder. The assembly further includes a distal member, possessing a fastener configured to removably attach to a shoring anchor located on the top portion of a shoring wall. The mediate portion of the restraining assembly is configured to concurrently retain both the proximal and distal members, including a tensioning means for the adjustment of the overall functional length of the restraining assembly. In particular embodiments, the restraining system includes a shoring or excavation support structure having at least one shoring wall that includes a multiplicity of shoring anchors attached at predetermined locations.

16 Claims, 3 Drawing Sheets

(56) References Cited

U.S. PATENT DOCUMENTS 4,924,971 A * 5/1990 Rice ..... E06C 1/34 182/107
5,529,145 A * 6/1996 Allred ..... E06C 1/36 182/107
5,896,945 A * 4/1999 Boelling ..... E06C 1/12 182/107
6,224,296 B1 * 5/2001 Fukumori ..... E02D 17/08 405/272
6,805,221 B1 * 10/2004 Lee ..... E06C 1/34 182/107
6,907,957 B1 * 6/2005 Couch ..... E02D 17/08 182/106
7,140,808 B2 * 11/2006 Raspotnik ..... E02D 17/08 405/282
7,845,468 B2 * 12/2010 Steblinski ..... 182/93
2004/0055820 A1 * 3/2004 Charlton ..... E06C 1/34 182/107
2005/0045421 A1 * 3/2005 Gaines ..... E06C 1/36 182/107
2006/0118360 A1 * 6/2006 Rivers ..... E06C 7/188 182/18
2007/0175699 A1 * 8/2007 Steblinski ..... E02D 17/08 182/82
2007/0246298 A1 * 10/2007 Botti ..... A62B 1/16 182/3
2008/0229702 A1 * 9/2008 Davidson ..... E02D 17/08 52/745.21
2009/0266646 A1 * 10/2009 Hamann ..... E06C 7/188 182/107
2010/0170748 A1 * 7/2010 Robichaud ..... E06C 1/345 182/107
2011/0253479 A1 * 10/2011 Gandy ..... E06C 7/486 182/107
2012/0186066 A1 * 7/2012 Chilton ..... E06C 7/182 29/525.01
2012/0186906 A1 * 7/2012 Chilton ..... A62B 1/06 182/3
2014/0131532 A1 * 5/2014 Elmore ..... E06C 7/48 248/201
2017/0303513 A1 * 10/2017 Hurwitz ..... D07B 1/148

FOREIGN PATENT DOCUMENTS

GB 2432621 A * 5/2007 ..... E06C 7/188
GB 2432621 A * 5/2007 ..... E06C 7/188
WO WO 2007015110 A1 * 2/2007 ..... E06C 7/188
WO WO-2007015110 A1 * 2/2007 ..... E06C 7/188

* cited by examiner

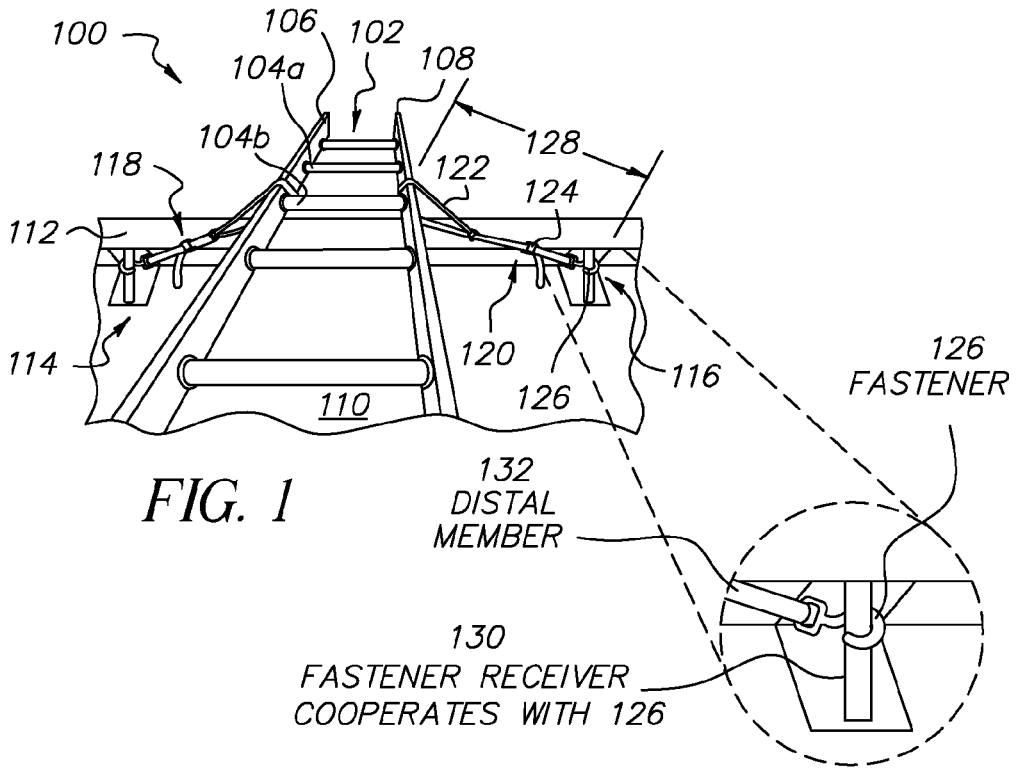
FIG. 1
FIG. 1A
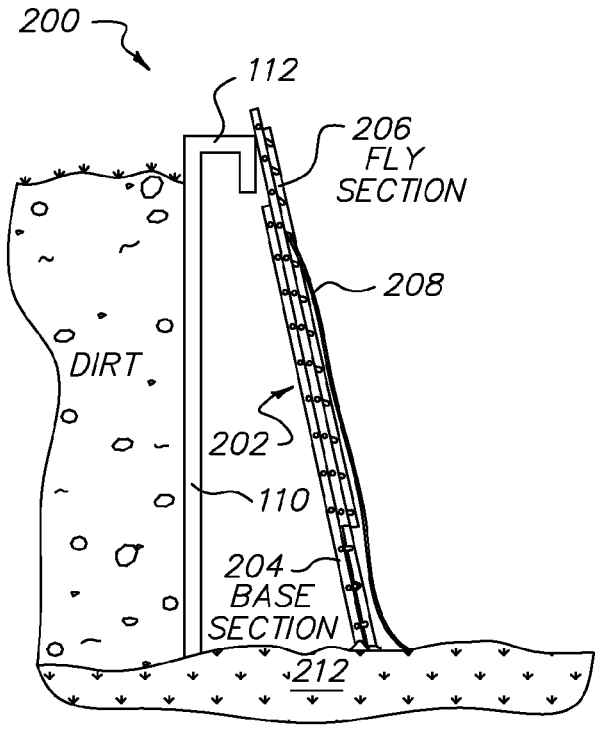
FIG. 2

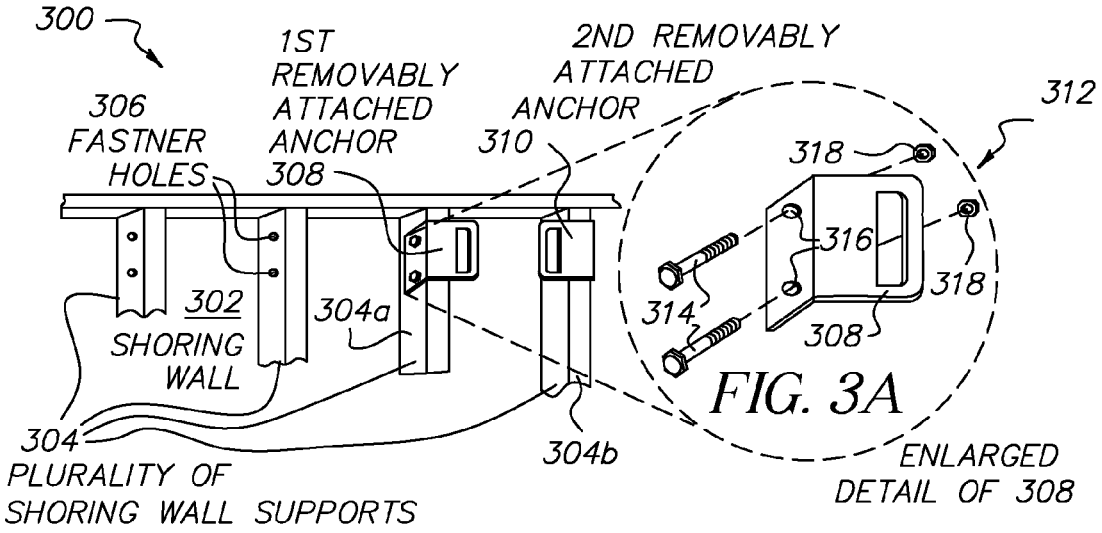
FIG. 3A
FIG. 3
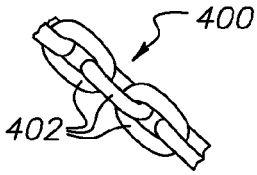
FIG. 4
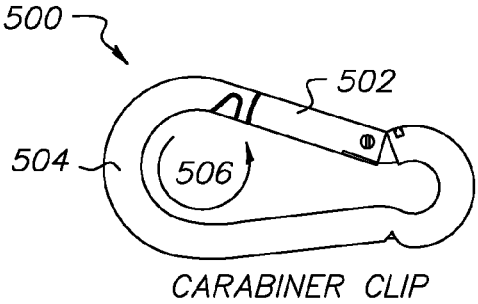
FIG. 5
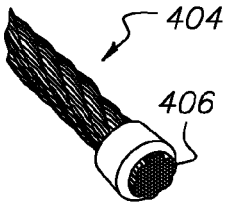
FIG. 4A
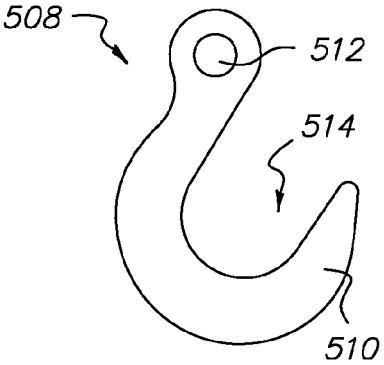
FIG. 5A
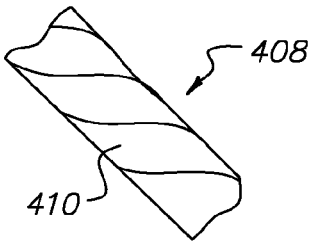
FIG. 4B

APPARATUS FOR DETACHABLY SECURING A LADDER TO A SHORING STRUCTURE AND METHOD OF USE THEREOF

FIELD OF THE INVENTION

This invention generally relates to a safety device or safety system for use on shoring structures or excavation support structures. In a more specific aspect, the present invention is primarily directed to an apparatus for detachably securing a portable ladder to a shoring wall that comprises a shoring structure.

BACKGROUND OF THE INVENTION

According to the World Health Organization, the United States leads the world in ladder deaths. Each year, in the United States, there are more than 164,000 emergency room visits and 300 deaths associated with falls from ladders. Falls from ladders are the leading cause of deaths on construction sites.

The United States Code of Federal Regulations (CFR), more specifically—section 29CFR 1926.1053, sometimes generally referred to as OSHA 1926, includes numerous regulations directed to ladder safety. With respect to safe ladder use, the CFR specifies that when portable ladders are used for access to an upper landing surface, the ladder side rails shall extend at least 3 feet (0.9 m) above the upper landing surface to which the ladder is used to gain access; or, when such an extension is not possible because of the ladder's length, then the ladder shall be secured at its top to a rigid support that will not deflect, and a grasping device, such as a grab-rail, shall be provided to assist employees in mounting and dismounting the ladder. In no case shall the extension be such that ladder deflection under a load would, by itself, cause the ladder to slip off its support.

Non-self-supporting ladders shall be used at an angle such that the horizontal distance from the top support to the foot of the ladder is approximately one-quarter of the working length of the ladder (the distance along the ladder between the foot and the top support). Ladders shall be used only on stable and level surfaces unless secured to prevent accidental displacement. Ladders shall not be used on slippery surfaces unless secured or provided with slip-resistant feet to prevent accidental displacement. Slip-resistant feet shall not be used as a substitute for care in placing, lashing, or holding a ladder that is used upon slippery surfaces including, but not limited to, flat metal or concrete surfaces that are constructed so they cannot be prevented from becoming slippery. Ladders placed in any location where they can be displaced by workplace activities or traffic, such as in passageways, doorways, or driveways shall be secured to prevent accidental displacement, or a barricade shall be used to keep the activities or traffic away from the ladder.

Additionally, the standard requires the employer to provide safe access and egress to all excavations. According to OSHA regulations, when employees are required to be in trench excavations 4 feet deep (1.22 meters) or more, adequate means of exit, such as ladders, steps, ramps or other safe means of egress, must be provided and be within 25 feet (7.62 meters) of lateral travel. If structural ramps are used as a means of access or egress, they must be designed by a competent person if used for employee access or egress, or a competent person qualified in structural design if used by vehicles. Also, structural members used for ramps or runways must be uniform in thickness and joined in a manner to prevent tripping or displacement.

There exists a multitude of situations where a ladder should be secured to prevent accidental displacement. Regulations and guidelines do not provide specific details with respect to mechanisms and/or methods to secure ladders, but expect the user(s) and/or responsible entity to provide the mechanisms and/or methods that reasonably meet the requirements. Accordingly, there is a need for user friendly ladder restraining the mechanisms and associated methods of use thereof that substantially meet governing standards.

SUMMARY OF THE INVENTION

The present invention is directed to a restraining apparatus, assembly, or system for detachably securing a ladder to a shoring or excavation support structure and method of use thereof. It is understood that the present invention includes several embodiments. The restraining assembly is primarily configured from an elongated flexible restraining material. The restraining assembly includes a proximal member, possessing a fastener configured to removably attach onto either side rail of a ladder. The assembly further includes a distal member, possessing a fastener configured to removably attach to a shoring anchor located on the top portion of a shoring wall. The mediate portion of the restraining assembly is configured to concurrently retain both the proximal and distal members, including a tensioning means for the adjustment of the overall functional length of the restraining assembly.

In particular embodiments, the restraining assembly or restraining system of the present invention includes a shoring or excavation support structure having at least one shoring wall that includes a multiplicity of shoring anchors attached at predetermined locations on the top portion thereof. Other embodiments include at least one shoring wall configured to receive a plurality of removably attachable shoring anchors so to provide a user the option to easily relocate or provide additional ladder access locations at a construction site.

Additional embodiments of the disclosure of the present invention further provide a method for securing a ladder to a shoring wall by the deployment of a first restraining assembly and a second restraining assembly to prevent accidental displacement.

It is another object of the present invention to provide such a restraining system that is simple and quick to install and remove.

It is yet another object directed to particular embodiments of the present invention to provide a restraining assembly that is fabricated from durable, high strength materials.

It is another object of this invention to provide a relatively simple system that is economical from the viewpoint of the manufacturer and consumer, is susceptible to low manufacturing costs with regard to labor and materials, and which accordingly evokes low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

PARTICULAR ADVANTAGES OF THE INVENTION

The present invention provides a relatively simple, cost-effective, efficient solution directed to securing a ladder to a shoring wall. Securing a ladder to a shoring wall helps prevent against accidental displacement; securing a ladder is required in many problematic or questionable ladder setups, including those where the support surface or ground in not level, unstable, slippery, or the like. The primary focus of the present invention is to provide a ladder retention system and method of use that enables a user to securely latch a ladder onto a shoring structure in a quick, reliable manner. Advantages of particular embodiments allow a ladder to be affixed to a multitude of locations on a shoring wall due to the use of shoring anchors that are removably attachable to the wall.

BRIEF DESCRIPTION OF THE DRAWINGS

The ensuing detailed description section makes reference to the annexed drawings. An enhanced understanding of the present invention will become evident when consideration is given to the detailed description thereof and objects other than the aforementioned become apparent. The invention will be described by reference to the specification and the annexed drawings, in which like numerals refer to like elements, and wherein:

FIG. 1 illustrates an isometric view of an exemplary ladder retention system 100, depicting a straight ladder canted against a shoring wall. The figure depicts a pair of restraining assemblies (i.e. first restraining assembly 118, and second restraining assembly 120) linking straight ladder 102 to top portion 112 of shoring wall 110.

FIG. 1A depicts an enlarged, detailed, isometric view of exemplary second anchor 116 shown in FIG. 1.

FIG. 2 illustrates an orthogonal side view of an exemplary ladder-shoring wall setup 200 (means for access and/or egress). The figure depicts extension ladder 202 having an adjusting height fly section 206.

FIG. 3 illustrates wall assembly 300, depicting an isometric view of a shoring wall with removably attachable anchors. Configurable shoring wall 302 configured to receive removably attachable anchors (e.g. 308, 310) depicts an exemplary configurable embodiment of the present invention.

FIG. 3A illustrates removably attachable anchor assembly 312 which is an isometric enlarged detail view of first removably attachable anchor 308. Assembly 312 depicts anchor holes 316 and exemplary fastening hardware, including bolt fasteners 314 and corresponding nuts 318.

FIG. 4 illustrates an isometric view of a chain 400 comprised of a plurality of links 402. Chain 400 is an example of an elongated flexible restraining material.

FIG. 4A illustrates an isometric view of a cable 404 comprised of a plurality of metallic strands 406. Cable 404 is an example of an elongated flexible restraining material.

FIG. 4B illustrates an isometric view of a rope 408 comprised of a plurality of fiber strands 410. Rope 408 is an example of an elongated flexible restraining material.

FIG. 5 illustrates an orthogonal front view of carabiner clip 500, possessing a body 504 and corresponding spring powered arm 502 which forms a closed shape 506 when in the closed condition. Carabiner clip 500 is an example of a fastening means.

FIG. 5A illustrates an orthogonal front view of hook 508, possessing a "C" shape body 510 with eye 512. Hook 508 possesses an open shape 514, and is an example of a fastening means.

DEFINITIONS OF TERMS USED IN THIS SPECIFICATION

Figure 6:
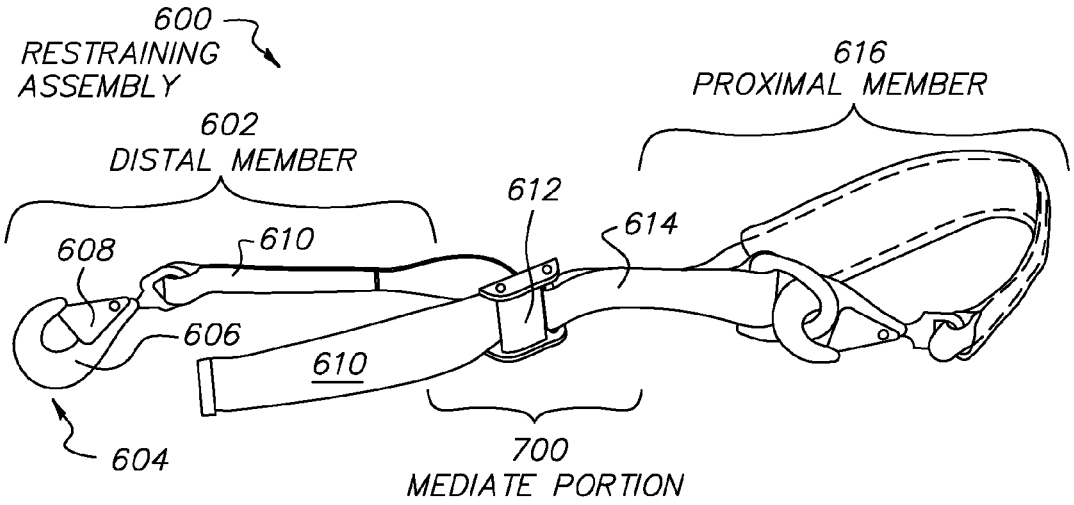
FIG. 6 illustrates an isometric view of restraining assembly 600. Restraining assembly 600 is comprised of distal member 602, proximal member 616, and mediate portion 700.

The apparatus for detachably securing a ladder to a shoring structure and method of use thereof discussed throughout this disclosure shall have equivalent nomenclature, including the device, the apparatus, the assembly, the ladder retention system, the system, the method, the present invention, or the invention. Additionally, the term exemplary shall possess a single meaning throughout this disclosure; wherein the sole definition pertains to serving as an example, instance, or illustration.

The term ladder shall refer to all non-self supporting ladder type configurations, whether commercially purchased or hand fabricated. Two popular non-self supporting ladder types include the straight ladder 102 (shown in FIG. 1) and extension ladder 202 (shown in FIG. 2).

To help facilitate disclosure understanding and streamline the location of figures and associated part numbers, a systematic parts/features numbering convention has been employed. The first digit in three digit part numbers refers to the figure number where the part was first introduced, or is best depicted. Likewise, in four digit part numbers, the first two digits refer to the figure number where the part was first introduced, or is best depicted. Although this disclosure may at times deviate from this convention, it is the intention of this numbering convention to enable expeditious comprehension of the disclosure.

PARTS/FEATURES LIST

100. ladder retention system
102. straight ladder
104*a*. upper rung
104*b*. lower rung
106. first side rail
108. second side rail (opposing side rail)
110. shoring wall
112. top portion (shoring wall)
114. first anchor (or first cleat)
116. second anchor (or second cleat)
118. first restraining assembly
120. second restraining assembly
122. loop fastening assembly (portion of proximal member)
124. tensioning means
126. fastener (quick release)
128. functional length (between 116 and 122)
130. fastener receiver (component of second anchor 116)
132. distal member (portion of restraining assembly 120)
200. ladder-shoring wall setup 200 (means for access and/or egress)
202. extension ladder
204. base section (of extension ladder 202)
206. fly section (of extension ladder 202)
208. adjustment line (for adjusting fly section 206)
212. ground
300. wall assembly (shoring wall with removably attachable anchors)
302. configurable shoring wall
304. shoring wall supports
304*a*. first shoring wall support
304*b*. second shoring wall support
306. fastener holes (for securing removably attachable anchors)
308. first removably attachable anchor
310. second removably attachable anchor
312. removably attachable anchor assembly (enlarged detail of 308)
314. bolt fasteners
316. anchor holes
318. nuts (mates with bolt fasteners 314)
400. chain
402. links
404. cable
406. metallic strands
408. rope
410. fiber strands
500. carabiner clip
502. spring powered arm
504. body
506. closed shape
508. hook
510. body ("C" shape structure)
512. eye
514. open shape
600. restraining assembly
602. distal member
604. flat snap hook
606. body
608. spring powered locking member (snap closer)
610. distal member strap
612. strap tensioner (tensioning means)
614. mediate portion strap
616. proximal member
700. mediate portion (or mediate member)
800. loop fastening assembly (exemplary proximal member embodiment)
802. D-ring
804. flat snap hook
806. body
808. spring powered locking member
810. strap (loop restraining member)
812. abrasion sleeve (abrasion protection means for strap 810)

DETAILED DESCRIPTION

With reference to the drawings of the present invention, several embodiments pertaining to the apparatus for detachably securing a ladder to a shoring structure and method of thereof will be described. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Terminology of similar import other than the words specifically mentioned above likewise is to be considered as being used for purposes of convenience rather than in any limiting sense.

It must be noted that as used herein and in the appended claims, the singular forms "a", "an", and "the" include plural reference unless the context clearly dictates otherwise. As well, the terms "a" (or "an"), "one or more" and "at least one" are considered equivalents, and therefore can be used interchangeably herein. It is also to be noted that the terms "comprising", "including", "characterized by", "possessing" and "having" are all to be interpreted as open ended equivalent terms, and are therefore used interchangeably.

FIG. 1 illustrates an isometric view of an exemplary ladder retention system 100, depicting straight ladder 102 canted against shoring wall 110. Shoring wall 110 is understood to encompass a variety of embodiments. One embodiment is directed to a stand-alone, single shoring wall 110 type structure, another embodiment is directed to a larger shoring structure or excavation support structure where at least one shoring wall 110 forms a portion of a multi-walled shoring structure; for example, a typical trench shoring system which is rectangularly configured from an array of four joined shoring walls 110.

Shoring wall 110 comprises a first anchor 114 (or cleat) and a second anchor 116 affixed to top portion 112 of shoring wall 110. The first and second anchors are horizontally separated from each other to permit, between the anchors, the installation of straight ladder 102, first restraining assembly 118, and second restraining assembly 120, as depicted in FIG. 1. In preferred embodiments, first anchor 114 and second anchor 116 are constructed from a strong engineering material such as steel, and is permanently attached to shoring wall 110 via welding or the like. Each anchor possesses a fastener receiver 130 that is configured to fastenly cooperate with fastener 126. FIG. 1A depicts fastener receiver 130 in a preferred closed shape configuration, which greatly reduces the chances of fastener 126 slipping off (as opposed to a post type fastener receiver or the like). Other preferred shoring wall embodiments would include a multitude of anchors (e.g. a series of first anchor 114 & second anchor 116 pairs) to permit straight ladder 102 placement in a variety of locations and/or the installation of more than one ladder on the shoring wall(s).

Again referring to FIG. 1, straight ladder 102 is secured to shoring wall 110, to prevent accidental displacement, by the installation and use of first restraining assembly 118 and second restraining assembly 120. First restraining assembly 118 and second restraining assembly 120 are to be considered interchangeable with each other since the criteria for form, fit and function are virtually identical between the two assemblies. Therefore, descriptions, explanations, advantages, and the like, pertaining to one restraining assembly is understood to apply to the opposing restraining assembly. Both restraining assemblies are each generally comprised of three interconnected members or assemblies, including a proximal member, a distal member, and a mediate portion (as best depicted in FIG. 6). In general, the restraining assemblies are primarily configured from an elongated flexible restraining material or materials, which are substantially reliable, strong, and abrasion resistant. Because the restraining assemblies will often be used on outdoor construction sites, they must be able to withstand the elements, such as: rain, snow, dirt, dust, excessive heat and cold, intense sunlight, and the like.

Loop fastening assembly 122 (a type of proximal member, best depicted in FIG. 8) of first restraining assembly 120 is attached to first side rail 108 located on straight ladder 102. Distal member 132 includes fastener 126 (exemplary simple hook type design) that is adapted to temporarily attach to first anchor 116. The mediate portion of first restraining assembly 120 is configured to concurrently retain loop fastening assembly 122 (a portion of proximal member) and distal member 132, where the mediate portion includes a tensioning means 124 for the adjustment of first restraining assembly 120 to the configuration depicted by functional length 128. Functional length 128 is generally defined by the approximate distance between loop fastening assembly 122 (proximal fastening means) and fastener 126 (distal fastening means) when the entire length of second restraining assembly 120 is taut, or without any substantial slack.

Again referring to FIG. 1, loop fastening assembly 122 of second restraining assembly 118 is attached to second side rail 106 located on straight ladder 102 between upper rung 104*a* and lower rung 104*b*. This closed shape configuration created by first side rail 106, second side rail 108, upper rung 104*a* and lower rung 104*b* is a preferred fastening location on straight ladder 102 since it virtually eliminates any chance of loop fastening assembly 122 inadvertently slipping off (in contrast with an open shape attachment location, such as the furthermost portion of second side rail 106, which lacks the additional rung to form a closed shape configuration).

FIG. 2 illustrates an orthogonal side view of an exemplary ladder—shoring wall setup 200, where extension ladder 202 provides a means for access and/or egress. The nethermost portion of extension ladder 202 is supported by ground 212 while the upper region is supported by top portion 112 of shoring wall 110. Extension ladder 200 is yet another example of a non-self-supporting ladder, where fly section 206 is vertically adjustable with respect to base section 204. Vertical adjustment is achieved via adjustment line 208.

FIG. 3 illustrates an isometric view of wall assembly 300, comprising configurable shoring wall 302 configured from an array of shoring wall supports 304, including first shoring wall support 304*a* and second shoring wall support 304*b*. At least a portion of plurality of shoring wall supports 304 includes a means for receiving and attaching at least two removably attachable anchors, one such means are fastener holes 306. First removably attachable anchor 308 is attached to first shoring wall support 304*a* and second removably attachable anchor 310 is attached to second shoring wall support 304*b*. Removably attachable anchor assembly 312 shown in FIG. 3A, fastener holes 306 are configured to align with anchor holes 316 and sized to permit passage of bolt fasteners 314. The final fastening step involves the engagement and tightening of nuts 318 onto corresponding bolt fasteners 314. In preferred embodiments, all or most of the shoring wall supports 304 would include fastener holes 306, thereby enabling a user to install or relocate removably attachable anchor assemblies 312 to a variety of shoring wall 302 locations where a secure ladder access and/or egress is desired. FIG. 3A illustrates one example of a removably attachable anchor assembly 312, which includes first removably attachable anchor 308 that is configured to fastenly cooperate with fastener 126, or the like, disposed on distal member 132 as shown in FIG. 1A.

FIG. 4 illustrates an isometric view of a chain 400 comprised of a plurality of links 402. Chain 400 is an example of an elongated flexible restraining material. FIG. 4*a* illustrates an isometric view of a cable 404 comprised of a plurality of metallic strands 406. Cable 404 is another example of an elongated flexible restraining material. FIG. 4*b* illustrates an isometric view of a rope 408 comprised of a plurality of fiber strands 410. Rope 408 is yet another example of an elongated flexible restraining material. Restraining assemblies (e.g. 118 and 120) are primarily configured from elongated flexible restraining type material (s). A flexible strap functions as the elongated flexible restraining material in exemplary first restraining assembly 118 and second restraining assembly 120 shown in FIG. 1; in addition to mediate portion strap 614 and distal member strap 610 depicted in FIG. 6. A restraining assembly can utilize a variety of elongated flexible restraining type of materials, which include, but not limited to straps, ropes, cables, chains, or any combination thereof.

FIG. 5 illustrates an orthogonal front view of carabiner clip 500, possessing a body 504 and corresponding spring powered arm 502 which forms a closed shape 506 when in the closed (shown) condition. Carabiner clip 500 is an example of a fastener that can be used as a distal fastening means for attaching to a cooperating shoring anchor(s). FIG. 5A illustrates an orthogonal front view of hook 508, possessing a "C" shape body 510 with eye 512. Hook 508 possesses an open shape 514, and is another example of a fastening means for attaching to a cooperating shoring anchor. Flat snap hook 608 of FIG. 6 is depicted as a preferred distal fastening means type fastener; since flat snap hook type fasteners are designed to remain securely attached once engaged onto a cooperating receiver.

FIG. 6 illustrates an isometric view of a preferred restraining assembly 600. Restraining assembly 600 is comprised of distal member 602, proximal member 616, and mediate portion 700. Distal member 602 is configured to attach to a cooperating shoring anchor (e.g. 114, 116 depicted in FIG. 1, and 308, 310 depicted in FIG. 3) disposed on a shoring wall. Proximal member 616 is configured to attach to a cooperating ladder side rail (e.g. 106, 108 depicted in FIG. 1). And mediate portion 700 that is configured to concurrently retain and manage both proximal member 616 and distal member 602; mediate portion 700 includes strap tensioner 612 that provides a means for the adjusting the distance between the proximal fastening means and the distal fastening means—defined as functional length 128 (shown in FIG. 1).

Referring to distal member 602, attached to distal member strap 610 is a flat snap hook 604 comprising a body 606 and a spring powered locking member 608. This type of quick release fastener is known for secure latching and is therefore a preferred type fastener for such safety type applications. Distal member strap 610 may be constructed from a variety of durable materials including materials derived from natural sources such as leather, cotton based textiles, and the like; as well as synthetic type materials—such as nylon, polyester; or any combination thereof. In preferred embodiments the device is constructed from UV resistant, wear-resistant, type of material or material combinations. It is understood that material considerations are largely dependent on a variety of factors, including: the desired properties or characteristics of the device dictated by application attributes, expected environmental conditions, device cost considerations, and the like.

Figure 7:
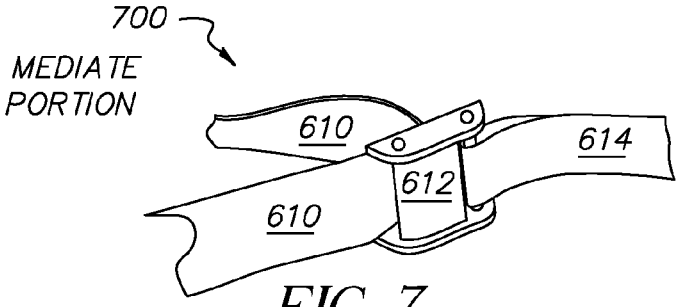
FIG. 7 illustrates an enlarged detailed isometric view of mediate portion 700 shown in FIG. 6. Mediate portion 700 is comprised of distal member strap 610, mediate portion strap 614, and strap tensioner 612.

FIG. 7 illustrates an enlarged detailed isometric view of mediate portion 700 shown in FIG. 6. Mediate portion 700 is comprised of distal member strap 610, mediate portion strap 614 which is shared with proximal member 616, and strap tensioner 612. Mediate portion 700, via strap tensioner 612 attached thereon, manages the distance between distal member 602 (which is configured to attach to a cooperating shoring anchor) and proximal member 616 (which is configured to attach to a cooperating ladder side rail). The distance management function of mediate portion 700 is to achieve a functional length 128 (shown in FIG. 1), the depicted condition occurs when the entire length of second restraining assembly 120 is taut, or without any substantial slack. The function of the strap tensioner 612 can be achieved by a variety of means. Examples of tensioning devices or systems are disclosed in U.S. Pat. No. 6,877,189 to Simonson, U.S. Pat. No. 4,185,360 to Prete, U.S. Pat. No. 4,617,703 to Schaeffer, and U.S. Pat. No. 6,149,133 to Skyba; all herein incorporated by reference in their entirety. Both Simonson and Prete are directed to the tightening of a strap. Schaeffer is directed to the tightening of a chain, cable, or rope. Skyba is directed to the tightening of a rope or cord. These exemplary tensioners provide a means for tensioning the aforementioned variety of elongated flexible restraining materials (e.g. strap, rope, cable, chain, or any combination thereof).

Figure 8:
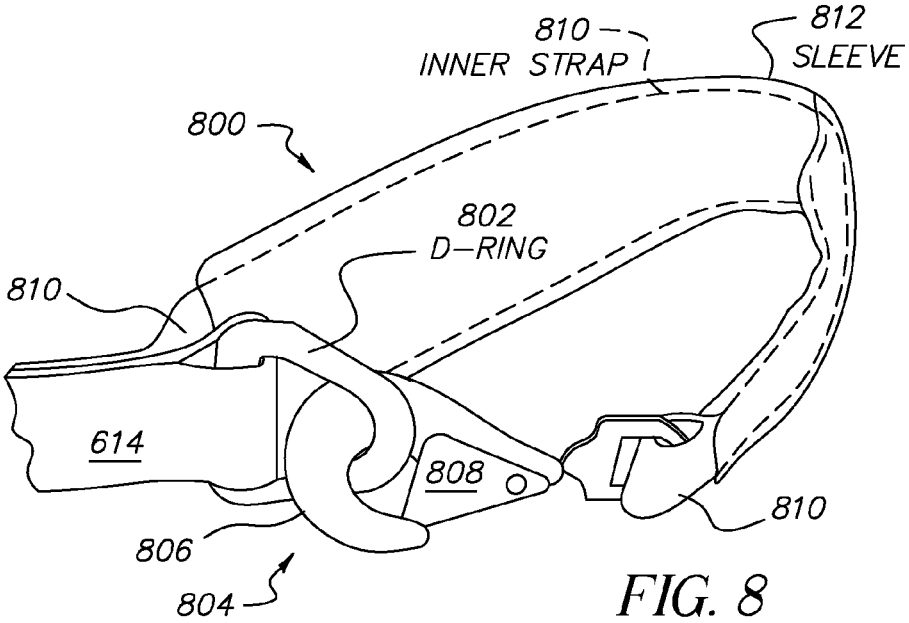
FIG. 8 illustrates an isometric view of loop fastening assembly 800. Loop fastening assembly 800 is exemplary embodiment of proximal member 616 shown in FIG. 6, and is an enlarged detailed depiction thereof. Loop fastening assembly 800 is comprised of strap 810, abrasion sleeve 812 disposed thereon; D-ring 802 fastened onto mediate portion strap 614 and cooperating flat snap hook 804.

FIG. 8 illustrates an isometric view of loop fastening assembly 800. Loop fastening assembly 800 is an exemplary embodiment of at least a portion of proximal member 616 shown in FIG. 6, and is an enlarged detailed depiction thereof. Loop fastening assembly 800 is comprised of strap 810 with optional abrasion sleeve 812 disposed thereon; D-ring 802 fastened onto mediate portion of strap 614 and is shown engaged with body 804 of cooperating flat snap hook 804 and is secured by spring powered locking member 808. Loop fastening assembly 800 is configured to quickly engage with any side rail of a cooperating ladder. In preferred embodiments, the assembly 800 is fabricated from materials that will not cause any undue wear on the ladder side rails, such as polymeric strap type materials; additionally, the assembly 800, as well as all other fastening members of the present invention are able to be manipulated (e.g. fastened, removed) manually, without the use of any tools.

Optional abrasion sleeve 812 functions as a protective covering for load bearing strap 810. As a secured ladder is used, abrasion of strap 810 may occur due to slight movements between the ladder side rails and strap 810. Abrasion sleeve 812 is preferably constructed from a flexible, abrasion resistant material. It is understood that the abrasion sleeve 812 can take other forms (e.g. a sewn on patch) and can be selected from a variety of sheet type materials (e.g. fabrics, textiles, and the like). Exemplary materials include: leather, canvas, natural (e.g. cotton), polymeric (synthetic) textiles, or any combination thereof. Polymeric textiles are preferred due to their strength, washability, durability, among other desirable attributes. Said polymeric textiles include materials such as Nylon, Cordura, Polyester, the like, and combination blends thereof.

The following is an exemplary method for securing a ladder to a shoring wall. It is understood that the order of certain steps is not material to the functionality or performance once the assembly of the present invention is properly configured (e.g. ladder retention system 100 of FIG. 1). The basic method includes, but is not limited to the following steps. The first step is fastening a proximal member of a first restraining assembly on to a first side rail of a ladder, and fastening a distal member of the first restraining assembly on to one of a plurality of shoring anchors disposed on a top portion of a shoring wall.

The next step is tensioning to remove slack from said first restraining assembly attached between the first side rail of said ladder and the one of the plurality of shoring anchors by engaging a tensioning means disposed on a mediate portion of the first restraining assembly. This is followed by fastening a proximal member of a second restraining assembly on to an opposing side rail of a ladder, and fastening a distal member of the second restraining assembly on to one of a plurality of shoring anchors disposed on a top portion of a shoring wall.

The next step includes tensioning to remove slack from the second restraining assembly attached between the opposing side rail of the ladder and the one of the plurality of shoring anchors by engaging a tensioning means disposed on a mediate portion of the second restraining assembly; whereby the ladder is secured to the shoring wall.

Other method embodiments would include the step of mounting at least one pair of removably attachable shoring anchors onto predetermined mounting locations on a configurable shoring wall 302. Another includable step is the positioning the ladder onto a predetermined location on the top portion of a shoring wall located between at least one pair of cooperating shoring anchors (removably attachable or permanently attached.

What is claimed herein is:

1. A pair of restraining assemblies, comprising an elongated flexible restraining material, securing a ladder canted against an excavation support wall, wherein the ladder is comprised of a first side rail and an opposing side rail; and said excavation support wall having a top portion including a plurality of shoring anchors disposed thereon on a side of said excavation support wall facing said ladder; each of said restraining assemblies comprising a proximal member, a distal member, and a mediate member between said proximal member and said distal member, wherein:

said proximal member having a proximal fastener wherein said proximal member of a first of said pair of restraining assemblies is looped around the first side rail on the ladder and fastened to a first cooperating fastener on said mediate member by a first said proximal fastener forming a first restraining loop and wherein said proximal member of a second of said pair of restraining assemblies is looped around the opposing side rail on the ladder and fastened to a second cooperating fastener on said mediate member by a second said proximal fastener forming a second restraining loop and wherein an abrasion resistant textile material is fastened only on said proximal member of each of said pair of restraining assemblies that is looped around said side rail of said ladder, whereby said looped portion of said restraining assembly is shielded from damaging abrasive forces;

said distal member having a distal fastener configured to attach to one of said plurality of shoring anchors on said excavation support wall, each shoring anchor having a mounting location on said excavation support wall; and said mediate portion, configured to concurrently retain said proximal member and said distal member, including a tensioner for an adjustment of a functional length defined by a distance between said proximal fastener and said distal fastener wherein said tensioner is configured to adjust said functional length so that said restraining assembly is taut.

2. The restraining assembly of claim 1, wherein said elongated flexible restraining material is selected from a group consisting of a strap, rope, cable, and chain.

3. The restraining assembly of claim 1, wherein said proximal fastener is selected from a group consisting of a hook, carabiner clip and a flat snap hook.

4. The restraining assembly of claim 1, wherein said proximal fastener is a loop fastening assembly, wherein said loop fastening assembly is comprised of a loop restraining member having a first end and a second end; said first end having a quick release fastener attached thereon, and said second end attached to said mediate member having a receiving fastener attached thereon configured to fastenably cooperate with said quick release fastener, whereby a retaining loop is created when said quick release fastener is fastened onto said receiving fastener.

5. The restraining assembly of claim 1, wherein said distal fastener is selected from a group consisting of a hook, carabiner clip and a flat snap hook.

6. A ladder retention system comprising:

an excavation support wall having a top portion including a plurality of shoring anchors, each having a mounting location on a side of said excavation support wall facing a ladder, disposed thereon; and a pair of restraining assemblies, primarily configured from an elongated flexible restraining material, securing said ladder canted against said excavation support wall wherein said ladder is comprised of a first side rail and an opposing side rail, each of said restraining assemblies comprising a proximal member, a distal member, and a mediate member between said proximal member and said distal member, wherein:

said proximal member having a proximal fastener wherein said proximal fastener is a loop fastening assembly, wherein said loop fastening assembly is comprised of a loop restraining member having a first end and a second end; said first end having a quick release fastener attached thereon, and said second end attached to said mediate member having a receiving fastener attached thereon configured to fastenably cooperate with said quick release fastener, whereby a restraining loop is created when said quick release fastener is fastened onto said receiving fastener, wherein said restraining loop of a first of said pair of restraining assemblies is looped around said first side rail on said ladder and wherein said restraining loop of a second of said pair of restraining assemblies is looped around said opposing side rail on said ladder wherein an abrasion resistant textile material is fastened only on said proximal member of each of said pair of restraining assemblies that is looped around said side rail of said ladder, whereby said looped portion of said restraining assembly is shielded from damaging abrasive forces;

said distal member having a distal fastener configured to attach to one of said plurality of shoring anchors, said ladder positioned between a pair of said shoring anchors; and said mediate portion, configured to concurrently retain said proximal member and said distal member, including a tensioner for an adjustment of a functional length defined by a distance between said proximal fastener and said distal fastener wherein said tensioner is configured to adjust said functional length so that said restraining assembly is taut.

7. The ladder retention system of claim 6, wherein said elongated flexible restraining material is selected from a group consisting of a strap, rope, cable, and chain.

8. The ladder retention system of claim 6, wherein said quick release fastener is selected from a group consisting of a hook, carabiner clip and a flat snap hook.

9. The ladder retention system of claim 6, wherein said distal fastener is selected from group consisting of a hook, carabiner clip and a flat snap hook.

10. The ladder retention system of claim 6, wherein at least one of said plurality of shoring anchors is removably attachable, wherein said mounting location is a wall support member having fastener holes therein for attaching said shoring anchor.

11. The ladder retention system of claim 6, wherein at least one of said plurality of shoring anchors is permanently attached to said mounting location by welding.

12. A ladder retention system comprising:

at least one pair of shoring anchors removably attached to shoring wall supports on a top portion of an excavation support wall on a side of said excavation support wall facing a ladder; and a pair of restraining assemblies, primarily configured from an elongated flexible restraining material having a proximal member, a distal member, and a mediate member between said proximal and distal members, securing said ladder canted against said excavation support wall wherein said ladder is comprised of a first side rail and an opposing side rail, each of said restraining assemblies comprising:

said proximal member having a proximal fastener wherein said proximal fastener is a loop fastening assembly, wherein said loop fastening assembly is comprised of a loop restraining member having a first end and a second end; said first end being an end of said proximal member having a quick release fastener attached thereon, and said second end being an end of said mediate member having a receiving fastener attached thereon configured to fastenably cooperate with said quick release fastener, whereby a restraining loop is created when said quick release fastener is fastened onto said receiving fastener, wherein said proximal member of a first of said pair of restraining assemblies is looped around said first side rail on said ladder and wherein said proximal member of a second of said pair of restraining assemblies is looped around said opposing side rail on said ladder and wherein an abrasion resistant textile material is fastened only on said proximal member of each of said first and second of said pair of restraining assemblies that is looped around said side rail of said ladder, whereby said looped portion of said restraining assembly is shielded from damaging abrasive forces;

said distal member having a distal fastener configured to attach to said at least one shoring anchor, said ladder positioned between a pair of said shoring anchors; and said mediate portion, configured to concurrently retain said proximal member and said distal member, including a tensioner for an adjustment of a functional length defined by a distance between said proximal fastener and said distal fastener wherein said tensioner is configured to adjust said functional length so that said restraining assembly is taut.

13. The ladder retention system of claim 12, wherein said elongated flexible restraining material is selected from a group consisting of a strap, rope, cable, and chain.

14. The ladder retention system of claim 12, wherein said quick release fastener is selected from a group consisting of a hook, carabiner clip and a flat snap hook.

15. The ladder retention system of claim 12, wherein said distal fastener is selected from group consisting of a hook, carabiner clip and a flat snap hook.

16. A method for securing a ladder to an excavation support wall, comprising the steps of:

mounting at least one pair of removably attachable shoring anchors onto mounting locations disposed on the top portion of said excavation support wall on a side of said excavation support wall facing said ladder;

looping a proximal member of a first restraining assembly around a first side rail of said ladder by fastening a first cooperating fastener on an end of said proximal member to a second cooperating fastener on a mediate member of said first restraining member thereby forming a first restraining loop around said first side rail of said ladder, and fastening a distal member of said first restraining assembly on to a first of said at least one pair of shoring anchors wherein a first abrasion resistant textile material is fastened only on said first restraining loop, whereby said looped portion of said first restraining assembly is shielded from damaging abrasive forces;

thereafter tensioning to remove slack from said first restraining assembly attached between said first side rail of said ladder and said first shoring anchor by engaging a tensioner disposed on said mediate portion of said first restraining assembly;

thereafter looping a proximal member of a second restraining assembly around an opposing side rail of said ladder by fastening a first cooperating fastener on an end of said proximal member to a second cooperating fastener on a mediate member of said first restraining member thereby forming a second restraining loop around said opposing side rail of said ladder, and fastening a distal member of said second restraining assembly on to a second of said at least one pair of said shoring anchors wherein a second abrasion resistant textile material is fastened only on said second restraining loop, whereby said looped portion of said second restraining assembly is shielded from damaging abrasive forces; and thereafter tensioning to remove slack from said second restraining assembly attached between said opposing side rail of said ladder and said second shoring anchor by engaging a tensioner disposed on said mediate portion of said second restraining assembly; whereby the ladder is secured to the excavation support w all, positioned between a pair of said shoring anchors.

* * * * *